United States Patent [19]

Magnoni

[11] Patent Number: 5,046,660

[45] Date of Patent: Sep. 10, 1991

[54] CONTAINER COMPRISING A PLANAR BOTTOM AND A SUBSTANTIALLY CYLINDRICAL BODY SURFACE

[76] Inventor: Giordano Magnoni, Via Emilia EST 207, Modena, Italy, I-41100

[21] Appl. No.: 430,439

[22] Filed: Nov. 2, 1989

[30] Foreign Application Priority Data

Nov. 4, 1988 [DE] Fed. Rep. of Germany ... 8813832[U]

[51] Int. Cl.[5] ..... B65D 3/04

[52] U.S. Cl. ..... 229/4.5; 229/915; 229/93

[58] Field of Search ..... 229/4.5, 915, DIG. 11, 229/93; 206/503

[56] References Cited

U.S. PATENT DOCUMENTS

| | | | |
|---|---|---|---|
| 2,053,298 | 9/1936 | Reed | 229/4.5 |
| 2,058,592 | 10/1936 | Karlsson-Ygger | 229/4.5 |
| 3,070,257 | 12/1962 | Bojanowski . | |
| 3,141,597 | 7/1964 | Palmer | 229/915 |
| 3,322,262 | 5/1967 | Puente . | |
| 3,450,331 | 6/1969 | Tapiovaara | 229/915 |
| 3,713,576 | 1/1973 | Goebel | 229/4.5 |
| 3,743,165 | 7/1973 | Hopkins | 229/109 |
| 4,568,018 | 2/1986 | Husnik | 229/DIG. 11 |

FOREIGN PATENT DOCUMENTS

| | | | |
|---|---|---|---|
| 227156 | 5/1963 | Austria . | |
| 2900054 | 1/1979 | Fed. Rep. of Germany . | |
| 1408640 | 1/1965 | France . | |
| 75944 | 6/1952 | Norway | 229/4.5 |
| 494547 | 10/1938 | United Kingdom | 206/509 |

*Primary Examiner*—Gary E. Elkins

*Attorney, Agent, or Firm*—Fleit, Jacobson, Cohn, Price, Holman & Stern

[57] ABSTRACT

A container including a planar bottom and a substantially cylindrical body surface. At an upper closed end a plurality of upwardly directed vanes are provided. The upper end edges of the vanes extend in a plane parallel to the bottom. The container is simple and economical to make, requires little material, is easy to handle and is stackable.

14 Claims, 1 Drawing Sheet

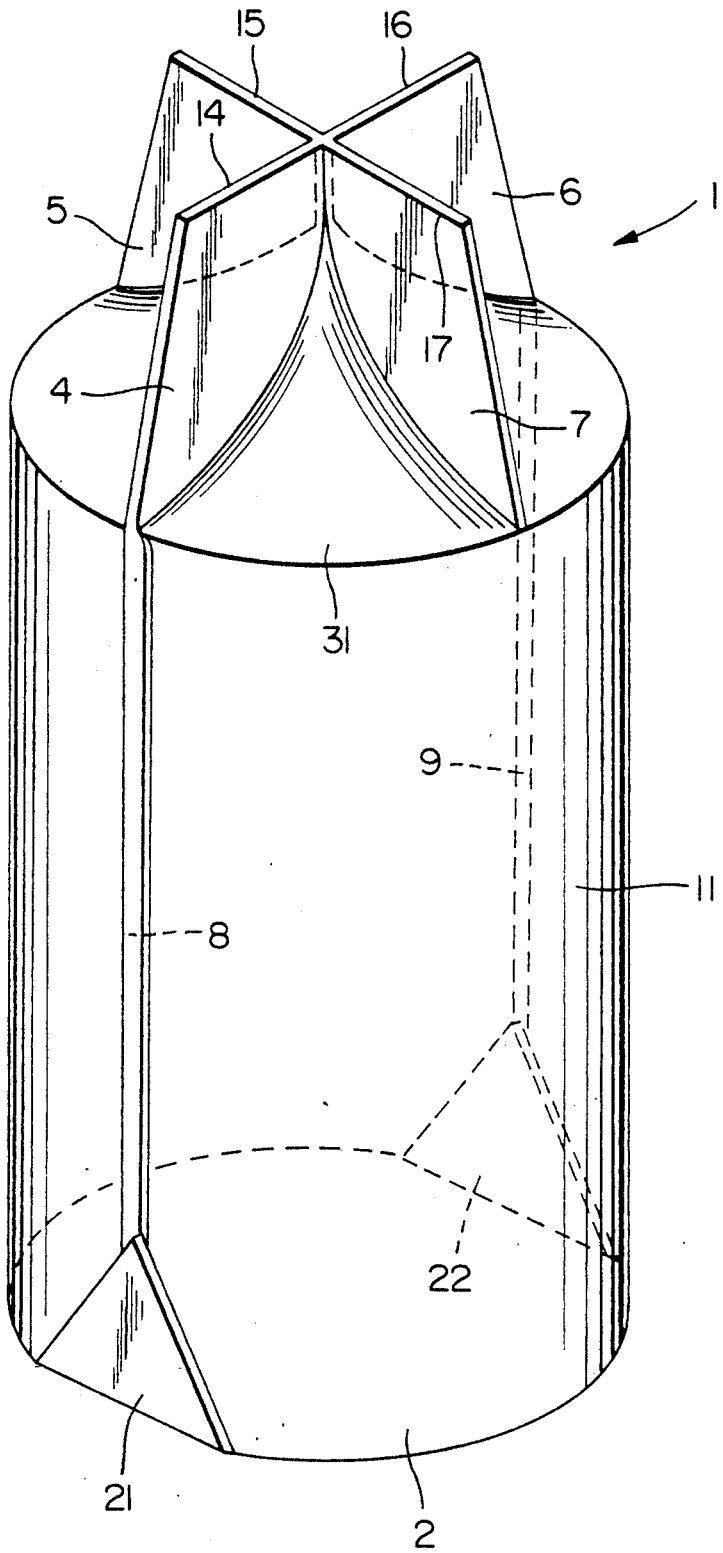
15
16
14
5
6
1
17
4
7
31
9
11
8
22
21
2

CONTAINER COMPRISING A PLANAR BOTTOM AND A SUBSTANTIALLY CYLINDRICAL BODY SURFACE

The invention relates to a container comprising a planar bottom and a substantially cylindrical body surface or jacket.

AT-PS 227,156 discloses a barrel having a substantially planar bottom and a convexly curved body surface. At the upper side of the container a bead edge arrangement is provided which consists of two integral annular bead extensions generated by stamping or pressing and which are joined by weld seams to the outer side of the arched end wall. The bead extensions have a substantially reniform shape and partially surround the bung piece. Each bead extension is made double-walled and punched and pressed from one piece of sheet metal. Each bead extension comprises a planar upper end face serving as support face. The side walls may be inclined; they widen from the upper support face downwardly in conical form so that the distance apart of the side walls at their lower edges is greater than the width of the support face.

DE-PS 2,900,054 discloses a container in the form of a can for beverages in which in the bottom integrally formed with the body a plurality of stiffening ribs are integrally formed which are distributed in the circumferential direction and extend radially and axially into the body and which have a common support face for the regions forming the can. The dispensing opening and the covering strip are arranged in a surface area recessed with respect to the support face of the bottom.

U.S. Pat. No. 3,070,257 discloses a cylindrical container which comprises on the lower side and upper side in each case protrusions and depressions which extend in star manner and are triangular in cross-section. When the containers are placed on each other they interlock along the spoke-like protrusions and depressions.

U.S. Pat. No. 3,322,262 discloses a container, in particular a transport container, which comprises protrusions at the upper side and the lower side. Each protrusion has an outer end face and side faces extending therefrom towards the container.

FR-PS 1,408,640 discloses a container which comprises at its upper side protrusions which consist of and faces and side walls.

The problem underlying the invention is to provide a container comprising a planar bottom and a substantially cylindrical body surface or main body which is simple and economical to make, requires little material, is easy to handle and is stackable.

According to the invention this problem is solved in that at the upper closed end of the container opposite the bottom a plurality of upwardly directed vanes are provided, the upper end edges of which extend in a plane parallel to the bottom. Thus, on a container an identical or similar container may be stacked in that the bottom face of the upper container is placed on the end edges of the upwardly directed vanes or wings of the lower container. The number of upwardly directed vanes can be adapted to the particular requirements. Thus, it is possible to provide for example three, four, five, six, seven or eight vanes. Optionally even more vanes may be provided. The greater the number of vanes the greater the stability and the heavier the containers which can be stacked on each other and the greater the number of container layers. The container may be opened in simple manner by pulling two opposite or approximately opposite vanes. Thus two opposite vanes or two approximately opposite vanes are gripped each in one hand and then pulled apart, thereby enabling the container to be easily and simply opened.

Preferably, the vanes consist of a surface-like configuration each having an upper end edge. This saves material.

The vanes preferably extend in the radial direction outwardly, thereby making the entire arrangement particularly stable.

Preferably, four vanes arranged in cross form are present. This gives with a structure which is symmetrical, simple and economical to make an adequately stable base area for the upper container stacked on the end edges. The four vanes arranged in cross form with their upper end edges extending in a surface parallel to the bottom form the support face for the container stacked thereon or to be more exact for the planar bottom face thereof.

Preferably, the bottom is made from reinforced material to ensure adequate stability in the stacking.

Adjoining the bottom a plurality of upwardly directed tabs may be provided. Said tabs serve for reinforcement and to increase the stability. Preferably, the tabs have the form of an upwardly directed triangle. It is advantageous for two tabs to be present on opposite sides of the bottom. The tabs of triangular configuration have one side of the respective triangle in common with the bottom. The opposite tip or apex of the triangle points upwardly.

On the body surface a plurality of upwardly directed longitudinal seams may be provided. Said longitudinal seams serve for reinforcement and stabilization. They may also be used to weld the remaining outer surface of the container. Preferably, two oppositely disposed longitudinal seams are present. A particularly simple structure is obtained if from each respective tip of a triangular tab a longitudinal seam extends upwardly. This structure is particularly simple and stable.

At the upper end of each longitudinal seam a vane may follow. This also increases the stability with simple structure. Furthermore, the container is then particularly easy to make.

The container consists preferably of paper, in particular kraft paper. It is advantageous for the container to be coated on the inner side, preferably with a thermoplastic heat-weldable material, in particular polyethylene.

Preferably, the bottom, the tabs, the longitudinal seams and/or the vanes are of reinforced material and the remaining parts, in particular the body and/or the upper closure of the container of weaker material. This makes it possible to obtain in particularly simple manner a container which is both stable and simple and cheap to make. The stability of the container is provided by the bottom surface consisting of reinforced material, the reinforcing tabs, the reinforcing longitudinal seams and the vanes made from reinforced or thickened material. The remaining parts of the container, i.e. the body surface and the upper closure of the container are made from weaker cheaper material. They serve only to close the container as a whole; they need not be made from the expensive reinforced material.

An example of embodiment of the invention will be described in detail hereinafter with the aid of the drawing.

The single FIG. shows a container in perspective view.

The closed container denoted as a whole by 1 comprises a planar bottom 2 and a substantially cylindrical body surface 11. At the upper closed end of the container opposite the bottom 2 four upwardly directed vanes 4, 5, 6, 7 are provided, the upper end edges 14, 15, 16, 17 of which extend in a plane parallel to the bottom 2. The four vanes 4, 5, 6, 7 are arranged in cross form. The angle between two vanes is thus 90° in each case. The vanes could also be referred to as reinforcing ribs.

Adjoining the bottom 2 two upwardly directed tabs 21, 22 are provided which each have the form of an upwardly directed triangle. The two tabs 21, 22 are disposed on opposite sides of the bottom 2. The tabs 21, 22 each have one side of the triangle in common with the bottom 2 whilst the opposite apex points upwardly.

Provided on the body surface 11 of the container 1 are two oppositely disposed longitudinal seams 8, 9 which extend in each case from a tip of the triangular tabs 21, 22 upwardly. The longitudinal seams 8, 9 thus run along a generatrix of the cylindrical container body 11. Adjoining the upper end of each longitudinal seam 8, 9 is a vane 4, 6. At the upper end of the longitudinal seam 8 the vane 4 follows, the vane 6 adjoining the upper end of the longitudinal seam 9.

The upper closure 31 of the container is made from four gusset-shaped pieces, each gusset-shaped end piece lying between two vanes. The supporting structure of the container is formed by the bottom 2, the tabs 21, 22, the longitudinal seams 8, 9 and the vanes 4, 5, 6, 7; these parts are made from reinforced material and ensure stability of the container. The remaining parts, i.e. the jacket 11 and the upper closure 31, are made from weaker material. These parts serve only to completely close the container. They need not make any substantial contribution to the stability of the container.

The container is simple and economical to make. It is also stackable. Stacking is by placing a further container on the upper end edges 14, 15, 16, 17, running in a plane parallel to the bottom 2, of the upwardly directed vanes 4, 5, 6, 7, the other container being placed thereon with its planar bottom face 2. The vanes arranged in cross manner afford an adequately large and stable support.

The container can be opened in simple manner. For this purpose two opposite vanes are gripped with the fingers, for example the vanes 5 and 7 or the vanes 4 and 6.

Thereafter the vanes are pulled apart, thereby opening the container.

The invention thus provides a container which can be made simply and economically, is stackable, adequately stable and as simple as possible.

I claim:

1. A container comprising a planar bottom, a substantially cylindrical body surface having two ends, the bottom being located at one end of the body surface, an upper closed end being located at the other end of the body surface, opposite the bottom, a plurality of upwardly directed vanes formed at the upper closed end, upper end edges of the vanes extend in a place parallel to the bottom, and a plurality of upwardly directed tabs adjoin the bottom.

2. Container according to claim 1, wherein the vanes are flat.

3. Container according to claim 1, wherein the vanes extend in a radially outward direction.

4. Container according to claim 3, wherein four vanes are arranged in a cross form.

5. Container according to claim 4, wherein the bottom is made from reinforced material.

6. Container according to claim 1, wherein the plurality of tabs have the form of a triangle.

7. Container according to claim 1, wherein one tab is located on opposite sides of the bottom.

8. Container according to claim 7, wherein the body surface includes a plurality of upwardly directed longitudinal seams.

9. Container according to claim 8, wherein one of the plurality of longitudinal seams is located on opposite sides of the body surface.

10. Container according to claim 9, wherein each longitudinal seam extends upwardly from a tip of one of the tabs.

11. Container according to claim 10, wherein one of the vanes adjoin an upper end of each longitudinal seam.

12. Container according to claim 11, wherein the container includes kraft paper.

13. Container according to claim 12, wherein the kraft paper is coated on an inner side with a thermoplastic hot-sealable material.

14. Container according to claim 13, wherein at least one of the bottom, the tabs, the longitudinal seams and the vanes include reinforced material.

* * * * *